US008944846B2

(12) United States Patent
Lee

(10) Patent No.: US 8,944,846 B2
(45) Date of Patent: Feb. 3, 2015

(54) ELECTRICAL SIGNAL CONNECTOR

(71) Applicant: Chung-Yu Lee, New Taipei (TW)

(72) Inventor: Chung-Yu Lee, New Taipei (TW)

( * ) Notice: Subject to any disclaimer, the term of this patent is extended or adjusted under 35 U.S.C. 154(b) by 85 days.

(21) Appl. No.: 13/917,893

(22) Filed: Jun. 14, 2013

(65) Prior Publication Data

US 2014/0370748 A1 Dec. 18, 2014

(51) Int. Cl.
*H01R 24/38* (2011.01)
*H01R 9/05* (2006.01)

(52) U.S. Cl.
CPC ..... *H01R 9/0524* (2013.01)
USPC ..... 439/584

(58) Field of Classification Search
USPC ..... 439/63, 578, 583, 584
See application file for complete search history.

(56) References Cited

U.S. PATENT DOCUMENTS

| | | | | |
|---|---|---|---|---|
| 2,425,959 | A * | 8/1947 | Schoenborn | 174/88 C |
| 3,581,269 | A * | 5/1971 | Frey et al. | 439/584 |
| 6,790,083 | B1 * | 9/2004 | Chen | 439/583 |
| 6,960,101 | B1 * | 11/2005 | Chen | 439/578 |
| 2014/0060927 | A1 * | 3/2014 | Chiu | 174/75 R |

* cited by examiner

*Primary Examiner* — James Harvey
(74) *Attorney, Agent, or Firm* — Rosenberg, Klein & Lee

(57) ABSTRACT

An electrical signal connector for connecting a coaxial cable to a mating connector is disclosed to include a locknut, a metal central tube inserted through the locknut and defining a stop flange at one end, a barbed retaining portion at an opposite end, a locating groove around the periphery between the stop flange and barbed retaining portion and an annular bearing surface portion extending around the periphery between the stop flange and the locating groove, a chuck unit including a collar, which is press-fitted onto the annular bearing surface portion of the metal central tube and having longitudinal clamping strips suspending around the barbed retaining portion of the metal central tube, and a constraint shell surrounding the collar, and an actuation sleeve mounted within the constraint shell around the collar and manually axially movable relative to the chuck unit between two positions to compress or release the longitudinal clamping strips.

6 Claims, 7 Drawing Sheets

ELECTRICAL SIGNAL CONNECTOR

BACKGROUND OF THE INVENTION

1. Field of the Invention

The present invention is electrical signal connectors and more particularly to an electrical signal connector consisting of a locknut, a metal central tube, a chuck unit and an actuation sleeve, which enables the inserted coaxial cable to be quickly locked to the electrical signal connector by means of manually moving the actuation sleeve relative to the chuck unit without the use of a tool.

2. Description of the Related Art

FIG. 7 illustrates a conventional electrical signal connector (cable end connector) A for connecting a coaxial cable B to a mating connector (not shown). This electrical signal connector (cable end connector) A consists of a locknut A1, a metal central tube A2, a plastic cylindrical casing A3 and a metal barrel A4. The metal central tube A2 is fastened to one end of the locknut A1. The plastic cylindrical casing A3 is fastened to the same end of the locknut A1 around the metal central tube A2. The metal barrel A4 is attachable to the distal end of the plastic cylindrical casing A3. After insertion of the coaxial cable B into the plastic cylindrical casing A3, a crimping tool is operated to move the metal barrel A4 relative to the plastic cylindrical casing A3, and thereby compressing the plastic cylindrical casing A3 against the coaxial cable B. This installation procedure has following drawbacks:

1. A crimping tool must be operated to move the metal barrel A4 relative to the plastic cylindrical casing A3, lowering the speed of the operation and wasting much time and labor.
2. When operating the crimping tool, the electrical signal connector (cable end connector) A is held in the jaws of the crimping tool, and the user cannot make sure that the angular position of the coaxial cable B relative to the electrical signal connector (cable end connector) A is accurate. After installation, the coaxial cable B may be biased from the axial center of the electrical signal connector (cable end connector) A, resulting in failed installation. When this condition occurs, the front end of the coaxial cable B must be cut off, and the coaxial cable B must be installed in the electrical signal connector (cable end connector) A again. If the length of the coaxial cable B is insufficient after cutting, a new coaxial cable B will be necessary for replacement, complicating the installation and increasing the cost.

Therefore, it is desirable to provide an electrical signal connector (cable end connector), which facilitates quick installation without tool, saving much installation labor and time and preventing angular deviation of the installed coaxial cable.

SUMMARY OF THE INVENTION

The present invention has been accomplished under the circumstances in view. It is therefore the main object of the present invention to provide an electrical signal connector for connecting a coaxial cable to a mating connector, which facilitates quick installation without any hand tool, saving much installation time and labor, preventing angular deviation of the coaxial cable, and increasing yields.

To achieve this and other objects of the present invention, an electrical signal connector in accordance with the present invention comprises a locknut, a metal central tube, a chuck unit, and an actuation sleeve. The locknut comprises a mating hole extending through two opposing ends thereof, an inner thread disposed in one end of the mating hole, and an inside annular flange disposed in an opposite end of the mating hole. The metal central tube is inserted into the mating hole of the locknut, comprising an axial hole axially extending through two opposing ends thereof, a stop flange extending around the periphery thereof at one end, a barbed retaining portion extending around the periphery thereof at an opposite end, a locating groove extending around the periphery between the stop flange and barbed retaining portion of the metal central tube, and an annular bearing surface portion extending around the periphery between the stop flange and locating groove of the metal central tube. The chuck unit is mounted around the annular bearing surface portion of the metal central tube and stopped against the locknut outside the mating hole, comprising a collar surrounding the metal central tube and a constraint shell surrounding the collar. The collar comprises a receiving hole axially extending through two opposing ends thereof for the passing of the metal central tube, an inside annular stop flange disposed in one end of the receiving hole and attached to the annular bearing surface portion of the metal central tube and a plurality of longitudinal clamping strips equiangularly spaced around an opposite end of the receiving hole. The receiving hole of the collar is a tapered hole gradually increasing in diameter in direction away from the inside annular stop flange. The actuation sleeve is sleeved onto the collar within the constraint shell and axially movable relative to the chuck unit between two positions to compress the longitudinal clamping strips or to release the longitudinal clamping strips.

Further, after the locknut, the metal central tube, the chuck unit and the actuation sleeve are assembled, the user can insert the coaxial cable into the electrical signal connector, and then manually move the actuation sleeve relative to the chuck unit to compress the longitudinal clamping strips of the collar, and thus the coaxial cable is quickly and firmly secured to the electrical signal connector, saving much installation time and labor and preventing angular deviation of the coaxial cable.

DETAILED DESCRIPTION OF THE PREFERRED EMBODIMENT

Figure 1:
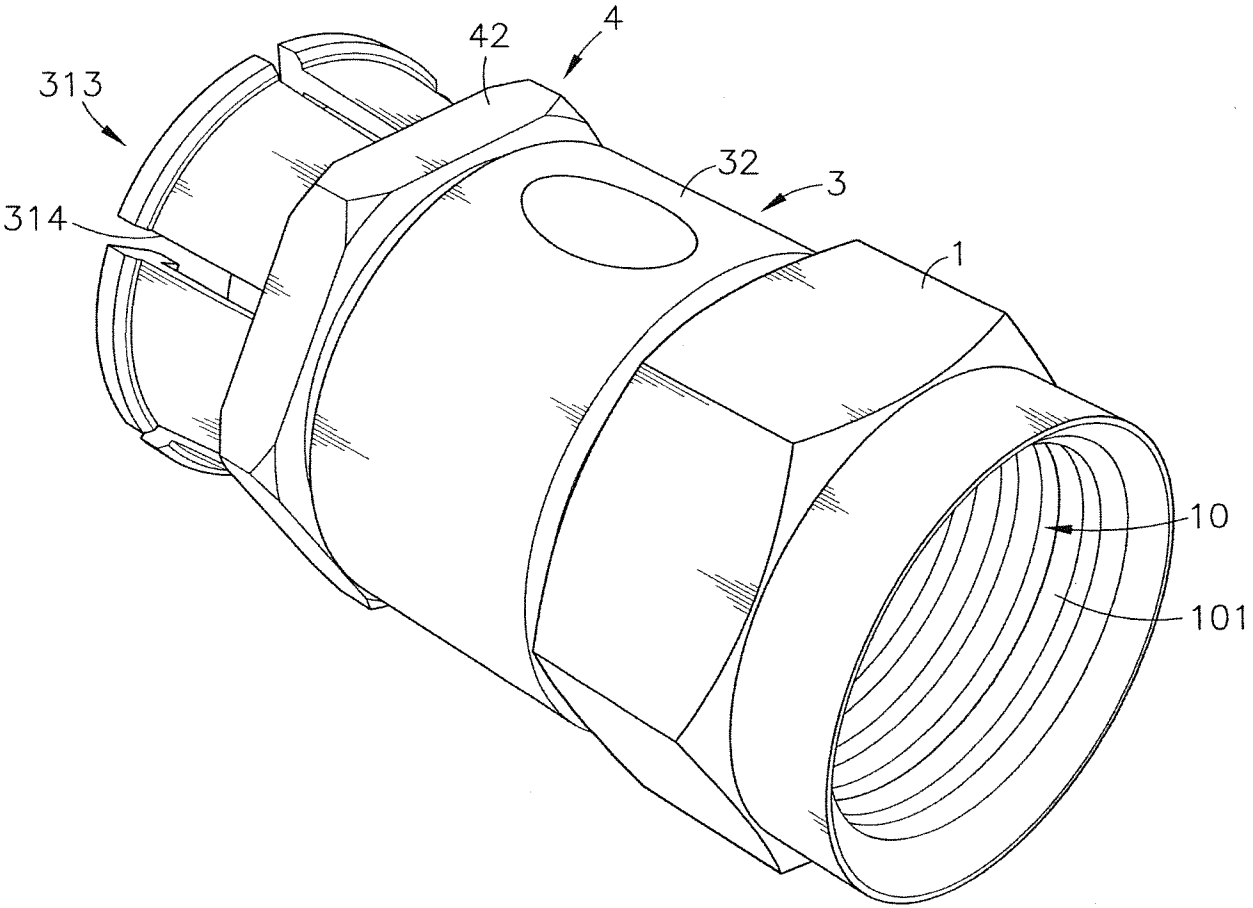
FIG. 1 is an oblique top elevational view of an electrical signal connector in accordance with the present invention.
Figure 2:
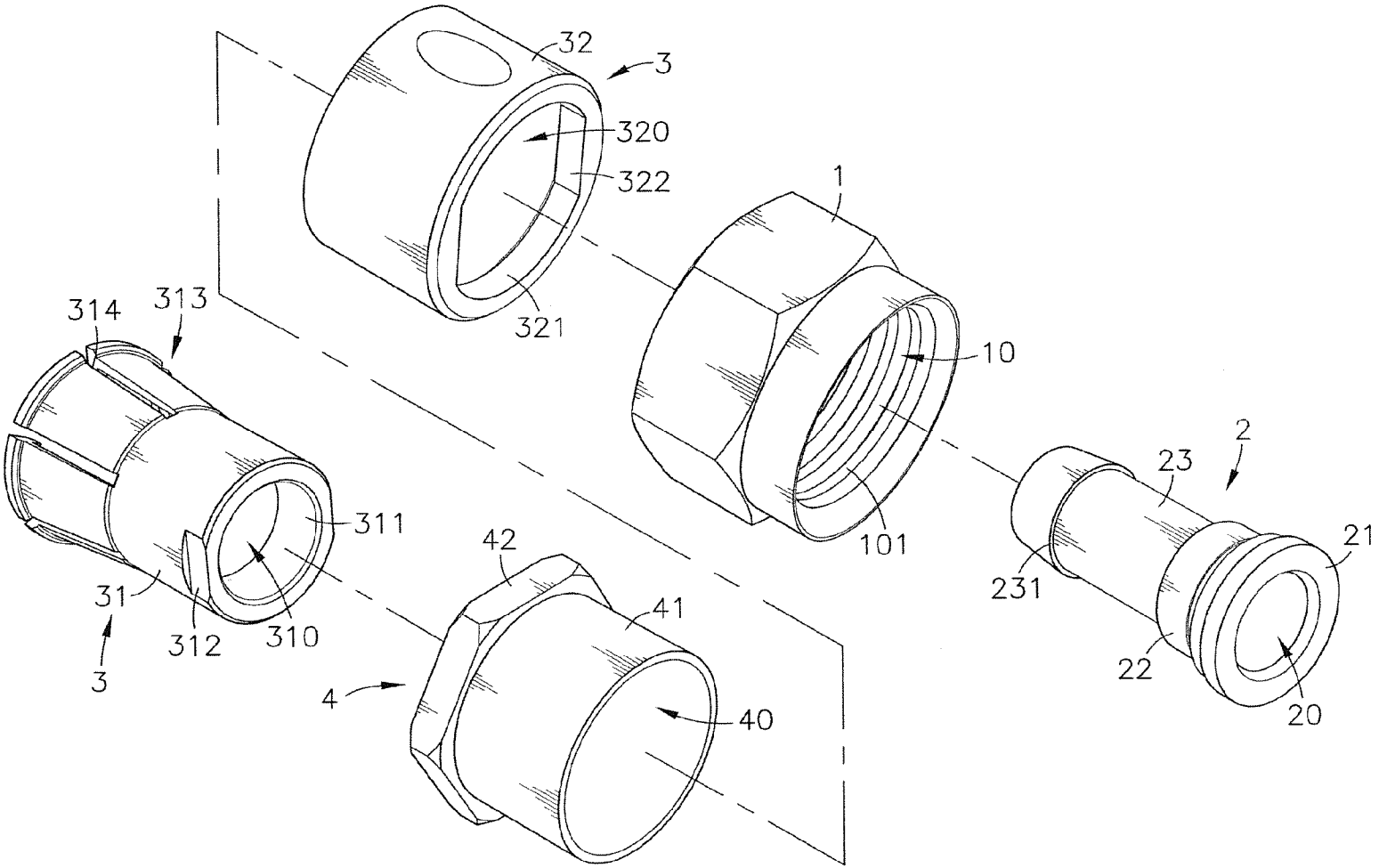
FIG. 2 is an exploded view of the electrical signal connector in accordance with the present invention.
Figure 3:
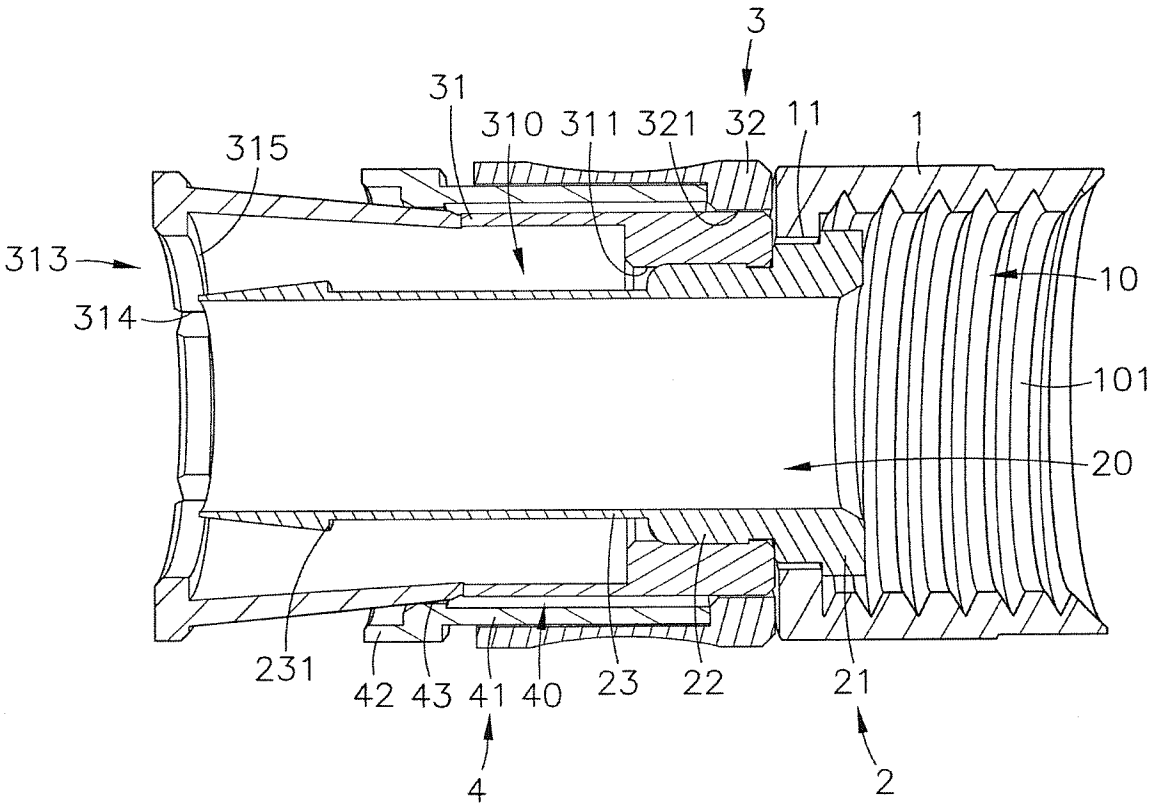
FIG. 3 is a sectional side view of the electrical signal connector in accordance with the present invention.

Referring to FIGS. 1-3, an electrical signal connector in accordance with the present invention is shown comprising a locknut 1, a metal central tube 2, a chuck unit 3, and an actuation sleeve 4.

The locknut 1 comprises a mating hole 10 extending through two opposing ends thereof, an inner thread 101 disposed in one end of the mating hole 10, and an inside annular flange 11 disposed in an opposite end of the mating hole 10.

The metal central tube 2 comprises an axial hole 20 axially extending through two opposing ends thereof, a stop flange 21 extending around the periphery thereof at one end, a barbed retaining portion 231 extending around the periphery thereof at the opposite end, a locating groove 23 extending around the periphery between the stop flange 21 and the barbed retaining portion 231, and an annular bearing surface portion 22 extending around the periphery between the stop flange 21 and the locating groove 23.

The chuck unit 3 comprises a collar 31 and a constraint shell 32. The collar 31 comprises a receiving hole 310 axially extending through two opposing ends thereof, an inside annular stop flange 311 disposed in one end of the receiving hole 310, at least one, for example, two cut planes 312 bilaterally located on the periphery of one end thereof corresponding to the inside annular stop flange 311, a plurality of longitudinal clamping strips 313 and a plurality of longitudinal crevices 314 alternatively disposed at the other end thereof, and a plurality of stop blocks 315 respectively located on an inner side of a distal end of each of the longitudinal clamping strips 313. The constraint shell 32 is shaped like a barrel and attached to one end of the collar 31 around the cut planes 312, comprising a stepped axial hole formed of a large diameter hole 320 and a small diameter hole 321 and extending through two opposite ends thereof, and at least one, for example, two flat stop flanges 322 bilaterally disposed in the small diameter hole 321 and fitting the cut planes 312 of the collar 31. The diameter of the large diameter hole 320 is larger than the outer diameter of the collar 31. The diameter of the small diameter hole 321 fits the outer diameter of the collar 31. The constraint shell 32 can be sleeved onto the collar 31 to abut the flat stop flanges 322 against the respective cut planes 312, prohibiting relative rotation between the collar 31 and the constraint shell 32. Further, the constraint shell 32 is relatively shorter than the collar 31. After the constraint shell 32 is attached to the collar 31 to abut the respective flat stop flanges 322 against the respective cut planes 312, the longitudinal clamping strips 313 of the collar 31 are kept suspending outside the constraint shell 32.

The actuation sleeve 4 comprises a sleeve body 41 defining an axially extending constraint hole 40, an outside stop flange 42 extending around the periphery of one end of the sleeve body 41, and an inside stop flange 43 extending around an inside wall of the sleeve body 41 corresponding to the outside stop flange 42.

When assembling the electrical signal connector, insert the metal central tube 2 into the mating hole 10 of the locknut 1 to abut the stop flange 21 of the metal central tube 2 against the inside annular flange 11 of the locknut 1, and then sleeve the chuck unit 3 onto the metal central tube 2 to attach the inside annular stop flange 311 of the collar 31 to the annular bearing surface portion 22 of the metal central tube 2 and to have the collar 31 and the constraint shell 32 be stopped against the inside annular flange 11 of the locknut 1 on the outside of the locknut 1, and then sleeve the actuation sleeve 4 onto the collar 3 to insert the sleeve body 41 of the actuation sleeve 4 into the large diameter hole 320 of the constraint shell 32 around the collar 31 and to have the outside stop flange 42 of the actuation sleeve 4 be stopped outside the constraint shell 32 and the inside stop flange 43 of the actuation sleeve 4 be stopped at the periphery of the collar 31 adjacent to the longitudinal clamping strips 313 of the collar 31. Thus, the locknut 1, the metal central tube 2, the chuck unit 3, and the actuation sleeve 4 are assembled, forming the desired electrical signal connector.

Further, the locknut 1 and the metal central tube 2 are made of metal; the chuck unit 3 and the actuation sleeve 4 can be made of metal or plastics. Further, in this embodiment, the collar 31 and constraint shell 32 of the chuck unit 3 are separately made and then assembled together. Alternatively, the chuck unit 3 can be a one-piece member, i.e., the constraint shell 32 can be directly molded on the collar 31. Further, the receiving hole 310 of the collar 31 is a tapered hole gradually increasing in diameter in direction away from the inside annular stop flange 311, i.e., the outer diameter of the collar 31 increases gradually in direction from the cut planes 312 toward the longitudinal clamping strips 313. Further, the outside wall of the outside stop flange 42 of the actuation sleeve 4 can be embossed, or configured to provide cut planes, raised surface portions and recessed surface portions, grooves, ribs or other means that enhance hand grip, enabling the user to move the actuation sleeve 4 relative to the chuck unit 3 toward the longitudinal clamping strips 313 of the collar 31 positively.

Figure 4:
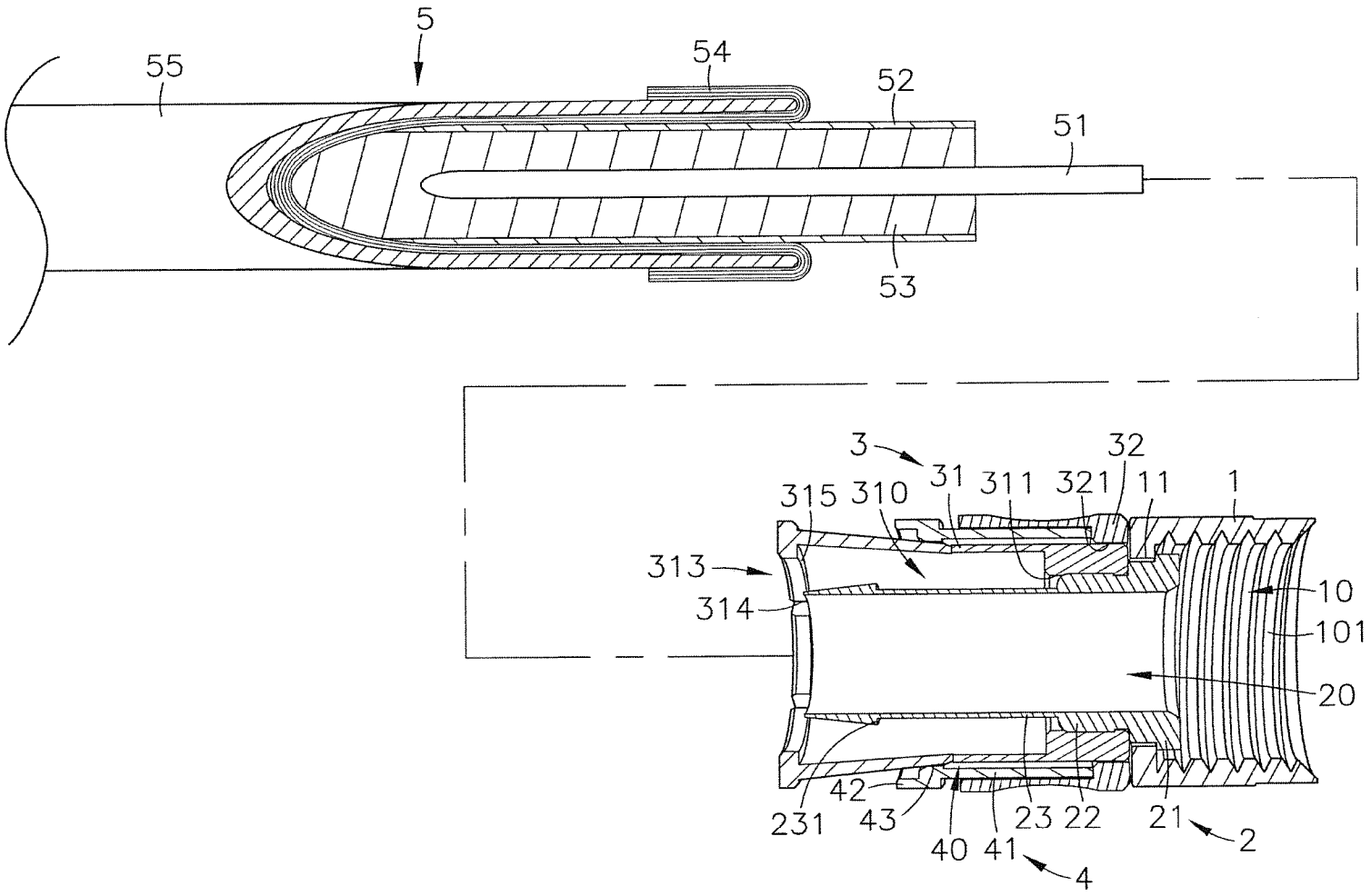
FIG. 4 is a schematic sectional applied view of the present invention (I).
Figure 5:
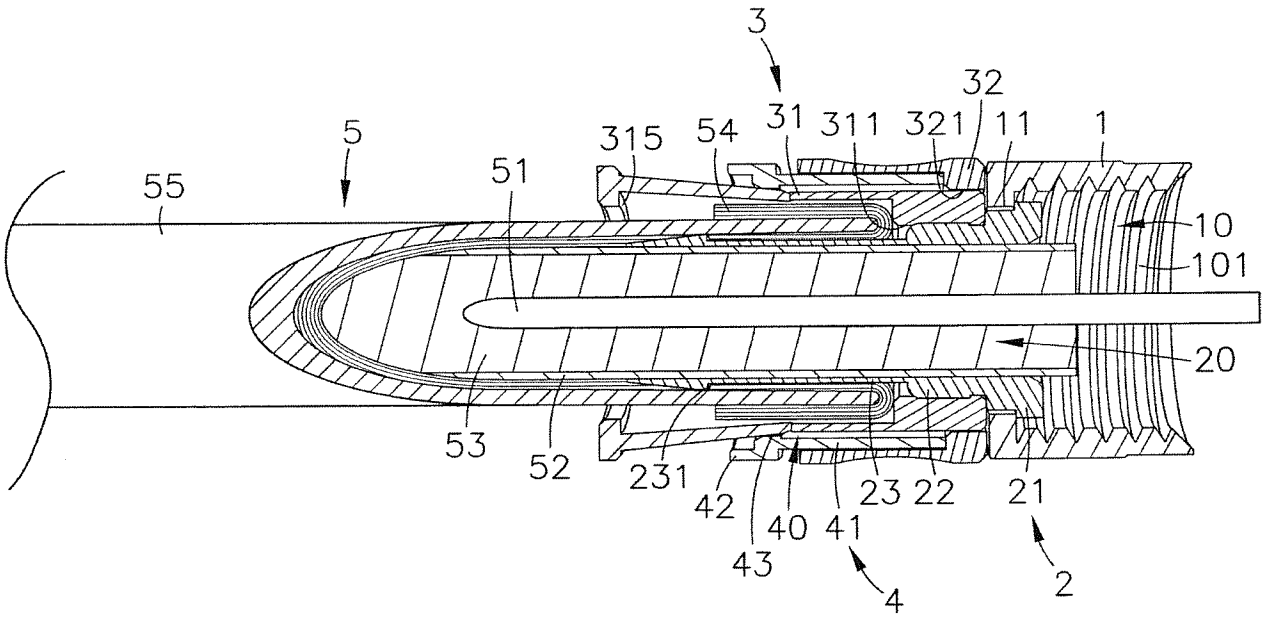
FIG. 5 is a schematic sectional applied view of the present invention (II).
Figure 6:
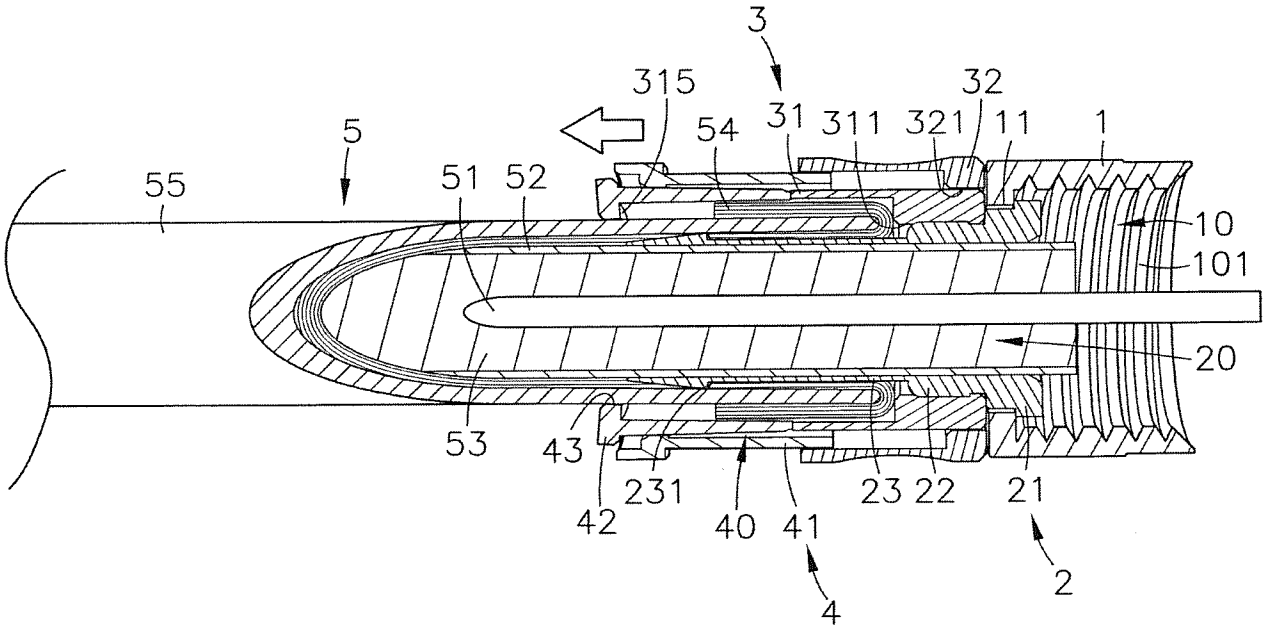
FIG. 6 is a schematic sectional applied view of the present invention (III).
Figure 7:
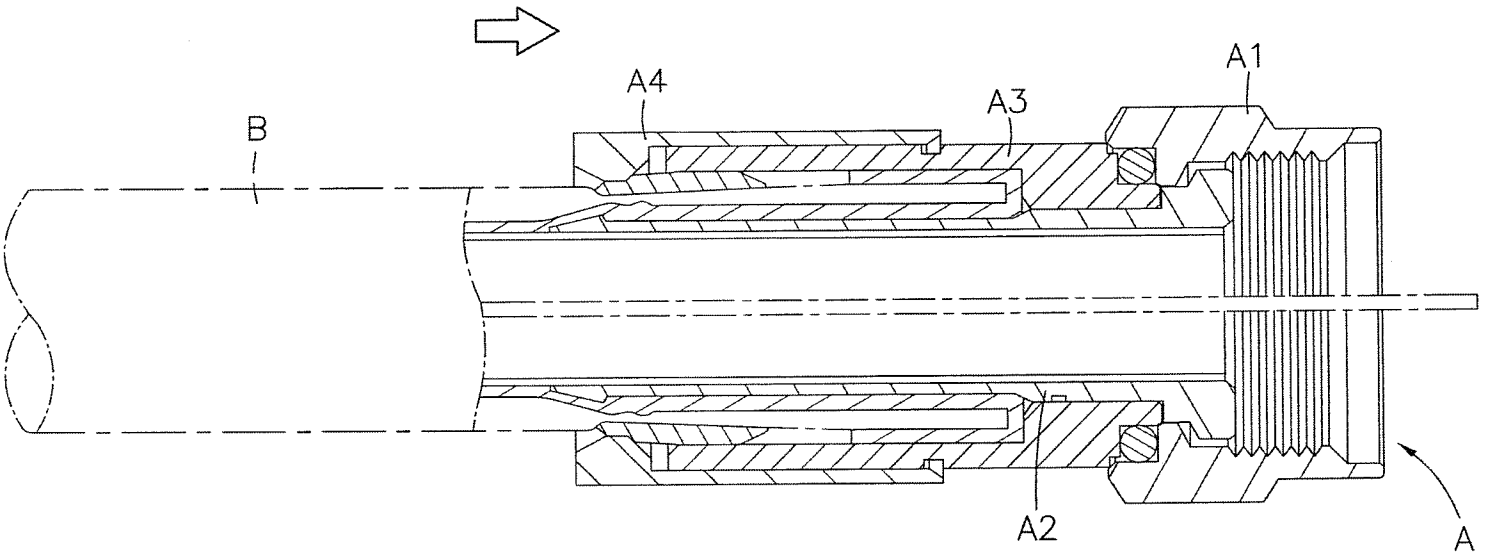
PRIOR ART FIG. 7
FIG. 7 is a sectional side view illustrating the assembly process of an electrical signal connector with a coaxial cable according to the prior art.

Referring to FIGS. 4-6 and FIG. 2 again, the electrical signal connector of the present invention is to be assembled with a coaxial cable 5 comprising a center conductor 51, an insulation spacer 53 surrounding the center conductor 51, a wrapping layer (Mylar film or aluminum foil) 52 surrounding the insulation spacer 53, a braided outer conductor 54 surrounding the wrapping layer 52, and a protective plastic covering 55 surrounding the braided outer conductor 54. During installation, the coaxial cable 5 is manually inserted into the receiving hole 310 of the collar 31 to let the center conductor 51, insulation spacer 53 and wrapping layer (Mylar film or aluminum foil) 52 of the coaxial cable 5 be forced into the axial hole 20 of the metal central tube 2 and the braided outer conductor 54 of the coaxial cable 5 turned backward and covered on the protective plastic covering 55 and received with the protective plastic covering 55 inside the receiving hole 310 of the collar 31 around the metal central tube 2. At this time, the user can grasp the outside stop flange 42 of the actuation sleeve 4 and then move the actuation sleeve 4 relative to the chuck unit 3 toward the longitudinal clamping strips 313 of the collar 31 to force the inside stop flange 43 of the actuation sleeve 4 against the longitudinal clamping strips 313 of the collar 31, thereby causing the stop blocks 315 to engage the outer periphery of the protective plastic covering 55 of the coaxial cable 5 tightly. After installation, the braided outer conductor 54 of the coaxial cable 5 is compressed by the collar 31 and secured to the locating groove 23 of the metal central tube 2, and the barbed retaining portion 231 is engaged into the inner perimeter of the braided outer conductor 54 of the coaxial cable 5 to force the braided outer conductor 54 radially outwardly against the collar 31, enhancing the connection tightness between the electrical signal connector and the coaxial cable 5. Thus, the user can rapidly install the coaxial cable 5 in the electrical signal connector manually without any hand tool, saving much installation time and labor, preventing angular deviation of the coaxial cable 5, and increasing yields.

In actual application, the electrical signal connector of the invention has the following advantages and features:

1. When installing a coaxial cable 5 in the electrical signal connector, the user can move the actuation sleeve 4 relative to the chuck unit 3 toward the longitudinal clamping strips 313 of the collar 31 to further compress the longitudinal clamping strips 313 of the collar 31, forcing the stop blocks 315 into engagement with the periphery of the protective plastic covering 55 of the coaxial cable 5 tightly, and therefore this installation procedure is quite simple without any tool, saving much installation labor and time.
2. By means of manual operation to move the actuation sleeve 4 relative to the chuck unit 3, the coaxial cable 5 can be quickly and firmly secured to the electrical signal connector, preventing angular deviation of the coaxial cable 5 and increasing the yields.

In conclusion, the invention provides an electrical signal connector comprising a locknut 1, a metal central tube 2, a chuck unit 3 consisting of a collar 31 and a constraint shell 32, and an actuation sleeve 4, and adapted for connecting a coaxial cable to a mating connector for signal transmission. During installation, the coaxial cable 5 is inserted into the receiving hole 310 of the collar 31 within the longitudinal clamping strips 313 of the collar 31 to force the center conductor 51, insulation spacer 53 and wrapping layer (Mylar film or aluminum foil) 52 of the coaxial cable 5 into the axial hole 20 of the metal central tube 2 and the back-folded braided outer conductor 54 of the coaxial cable 5 into the inside the receiving hole 310 of the collar 31 around the metal central tube 2, and then the user can move the actuation sleeve 4 relative to the chuck unit 3 toward the longitudinal clamping strips 313 of the collar 31 to lock the coaxial cable 5 to the electrical signal connector. This design of electrical signal connector facilitates quick installation without any tool, saving much installation time and labor and preventing angular deviation of the coaxial cable 5.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical signal connector for electrically connecting a coaxial cable to a mating connector, comprising:

a locknut comprising a mating hole extending through two opposing ends thereof, an inner thread disposed in one end of said mating hole, and an inside annular flange disposed in an opposite end of said mating hole;

a metal central tube inserted into said mating hole of said locknut and extending out of said locknut, said metal central tube comprising an axial hole axially extending through two opposing ends thereof, a stop flange extending around the periphery thereof at one end, a barbed retaining portion extending around the periphery thereof at an opposite end, a locating groove extending around the periphery between the stop flange and barbed retaining portion of said metal central tube, and an annular bearing surface portion extending around the periphery between the stop flange and locating groove of said metal central tube;

a chuck unit mounted around said annular bearing surface portion of said metal central tube and stopped against said locknut outside said mating hole, said chuck unit comprising a collar surrounding said metal central tube and a constraint shell surrounding said collar, said collar comprising a receiving hole axially extending through two opposing ends thereof for the passing of said metal central tube, an inside annular stop flange disposed in one end of said receiving hole and attached to said annular bearing surface portion of said metal central tube and a plurality of longitudinal clamping strips equiangularly spaced around an opposite end of said receiving hole; and an actuation sleeve sleeved onto said collar within said constraint shell and axially movable relative to said chuck unit between two positions to compress said longitudinal clamping strips or to release said longitudinal clamping strips.

2. The electrical signal connector as claimed in claim 1, wherein said constraint shell comprises a stepped axial hole formed of a large diameter hole and a small diameter hole and axially extending through two opposite ends thereof, the diameter of said large diameter hole being larger than the outer diameter of said collar, the diameter of said small diameter hole fitting the outer diameter of said collar.

3. The electrical signal connector as claimed in claim 1, wherein said collar and said constraint shell of said chuck unit are two separate members separately made and then attached together; said collar further comprises at least one cut plane located on the periphery of one end thereof; said constraint shell further comprises at least one flat stop flange disposed in a small diameter hole and respectively abutted against said at least one cut plane of said collar to prohibit relative rotation between said collar and said constraint shell.

4. The electrical signal connector as claimed in claim 1, wherein said collar further comprises a plurality of longitudinal crevices respectively disposed between each two adjacent said longitudinal clamping strips; said receiving hole is a tapered hole gradually increasing in diameter in direction away from said inside annular stop flange.

5. The electrical signal connector as claimed in claim 1, wherein said actuation sleeve comprises a sleeve body defining an axially extending constraint hole, an outside stop flange extending around the periphery of one end of said sleeve body, and an inside stop flange extending around an inside wall of said sleeve body corresponding to said outside stop flange.

6. The electrical signal connector as claimed in claim 1, wherein said constraint shell comprises a stepped axial hole formed of a large diameter hole and a small diameter hole and axially extending through two opposite ends thereof, the diameter of said large diameter hole being larger than the outer diameter of said collar, the diameter of said small diameter hole fitting the outer diameter of said collar; said actuation sleeve comprises a sleeve body axially movably mounted around said collar and receivable in said large diameter hole of said stepped axial hole of said constraint shell, a constraint hole defined in said sleeve body and adapted to receive said collar and to compress said longitudinal clamping strips of said collar, and an outside stop flange extending around the periphery of one end of said sleeve body.

* * * * *